United States Patent [19]

Su

[11] Patent Number: 5,002,228

[45] Date of Patent: Mar. 26, 1991

[54] ATOMIZER

[76] Inventor: Jeno Y. Su, #1186 Tong Da Rd, Hsinchu City, Taiwan

[21] Appl. No.: 379,929

[22] Filed: Jul. 14, 1989

[51] Int. Cl.[5] ..... B05B 9/043

[52] U.S. Cl. ..... 239/333; 222/321; 239/486

[58] Field of Search ..... 239/333, 486; 222/321, 222/380, 382

[56] References Cited

U.S. PATENT DOCUMENTS

| | | | |
|---|---|---|---|
| 3,379,381 | 4/1968 | Decaux | 239/333 |
| 4,025,046 | 5/1977 | Boris | 239/333 |
| 4,051,983 | 10/1977 | Anderson | 239/333 |
| 4,122,982 | 10/1978 | Giuffredi | 222/321 |
| 4,140,249 | 2/1979 | Majima | 239/333 |
| 4,144,987 | 3/1979 | Kishi | 239/333 |
| 4,305,530 | 12/1981 | Nozawa | 239/333 |
| 4,345,718 | 8/1982 | Horvath | 239/333 |
| 4,606,479 | 8/1986 | Van Brocklin | 239/333 |
| 4,735,347 | 4/1988 | Schultz et al. | 222/321 |
| 4,821,928 | 4/1989 | Su | 239/333 |
| 4,830,284 | 5/1989 | Maerte | 239/333 |

FOREIGN PATENT DOCUMENTS

| | | | |
|---|---|---|---|
| 1486392 | 5/1967 | France | 239/333 |

*Primary Examiner*—Andres Kashnikow
*Assistant Examiner*—M. Forman
*Attorney, Agent, or Firm*—Bacon & Thomas

[57] ABSTRACT

A pump-type atomizer is disclosed having a movable nozzle head and plunger that are operatively associated with a stationary cylindrical element. The cylindrical element has an upper portion and a lower portion, the lower portion having a tapered configuration such that its diameter decreases in a direction away from the upper portion. A valve element within the cylindrical element has a valve body which cooperates with a passage in the plunger to normally close the passage. The valve element also has a piston which, when the nozzle head is depressed, cooperates with the lower, tapered portion of the cylindrical element, in cooperation with the plunger, to enclose a portion of the liquid. Further movement of the nozzle head increases the pressure on this fluid, which overcomes a biasing force on the valve to open the valve and allow the fluid to pass through the passageway and exit through the nozzle head.

4 Claims, 2 Drawing Sheets

ATOMIZER

BACKGROUND OF THE INVENTION

1. Field of the Invention

This invention provides a liquid atomizer having an improved valve body.

2. Description of the prior art

A conventionally structured atomizer, mostly like that shown in FIG. 6, meant to atomize liquids contained therein, embodies a valve element which is composed, as a rule, of a pair of individually moulded, but correspondingly shaped hollow-set valve stubs 14*a*, 14*b*. Between such two semi-cylinders is mounted a steel ball check valve 14*c* to unite both together. Such a ball type valve as used in an atomizer has several disadvantages that should be removed in order to make best use of an atomizer. As one example, such a conventional ball valve 14*c* is typically made of rigid materials such that the presence of any kind of oxides adhered to its surface will add to the detriment of liquid-tight performance and eventually result in prejudicing the compression efficiency, further resulting in liquid drops being present in the resulting spray. Furthermore, in operation, the valve element 14 may easily get clogged in the wall surrounding the journal of the compression cylinder. Additionally, when a conventionally structured valve is subject to excessive externally induced shock, vibration or tilting stresses, the steel ball 14*c* will respond accordingly so that the high pressure liquids being compressed in the compression chamber will have a chance to enter the semi-cylinder by passing the interval gap existing between the steel ball 14*c* and the medium chamber 14*b*. All of these disadvantages are reflected in obvious reduction of the pressure prevailing in the compression cylinder and, consequently, reduction in the rate, power of the liquid being fed out, and substantial decrease in the atomizing performance of the nozzle head which would then eject atomized particles accompanied by liquid drops, rather than fully atomized particles.

In addition, the construction of a conventional valve element, disclosed accordingly, by virtue of a separately run production involving assembling procedures for the embodiment that necessarily incurs much labor and time, and of the additional costs owing to the presence of a steel ball to be fitted therebetween, is far from being advantageous from economical as well as production efficiency viewpoints.

SUMMARY OF THE INVENTION

A main objective of the present invention is to provide an atomizer wherein the valve body is prepared differently in contrast to the conventional steel valve bodies so that it will not suffer from any external shocks and maintain a tightly closed condition, a relatively higher compression ratio so as to permit optimum atomization, and which should prove advantageous in respect of economy of production costs. To achieve such an objective, there is provided an atomizer construction of a type incorporating a nozzle head connected to the plunger of a hollow-set piston in the lower section thereof, said piston being engaged by continuous overlapped fitting to a large diameter portion of a cylinder. The underside of the cylinder, having a reduced taper diameter, is engaged in the liquid container. The plunger is provided with a passage hole in association with the spraying outlet of the nozzle head, and tops the end portion of a valve body in communication with the valve seat being formed in the central area of the passage hole, to the effect that a steel spring seated in the reduced area of the cylinder will bear the end portion of the valve body against the valve seat such that the valve element may come to a position for fitting into the cylinder. A piston provided down the valve element will maintain a tightly bound engagement with the interior wall of the reduced diameter of the cylinder as the nozzle head is depressed.

DESCRIPTION OF THE PREFERRED EMBODIMENT

Figure 1:
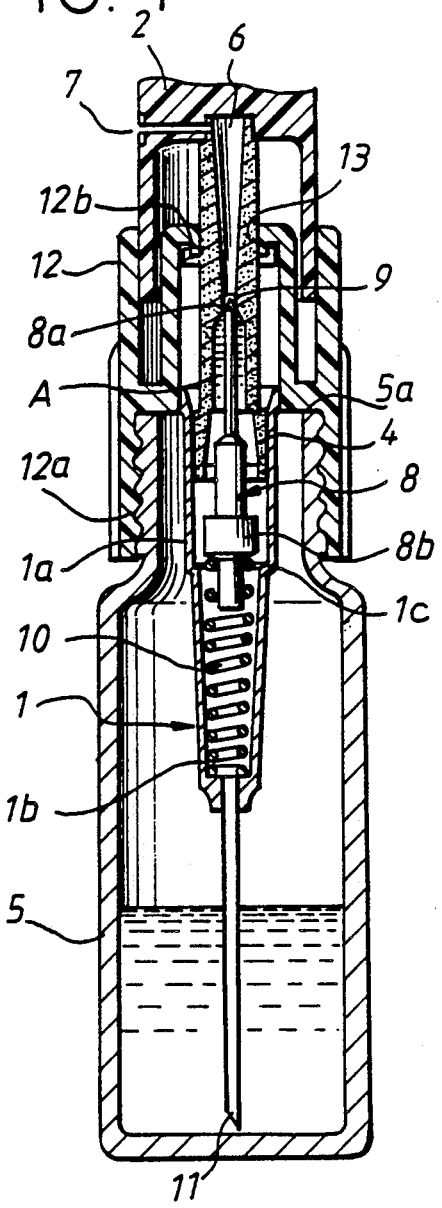
FIG. 1 is a longitudinal cross-sectional view of the atomizer structure in one illustrative, non-limiting embodiment.
Figure 2:
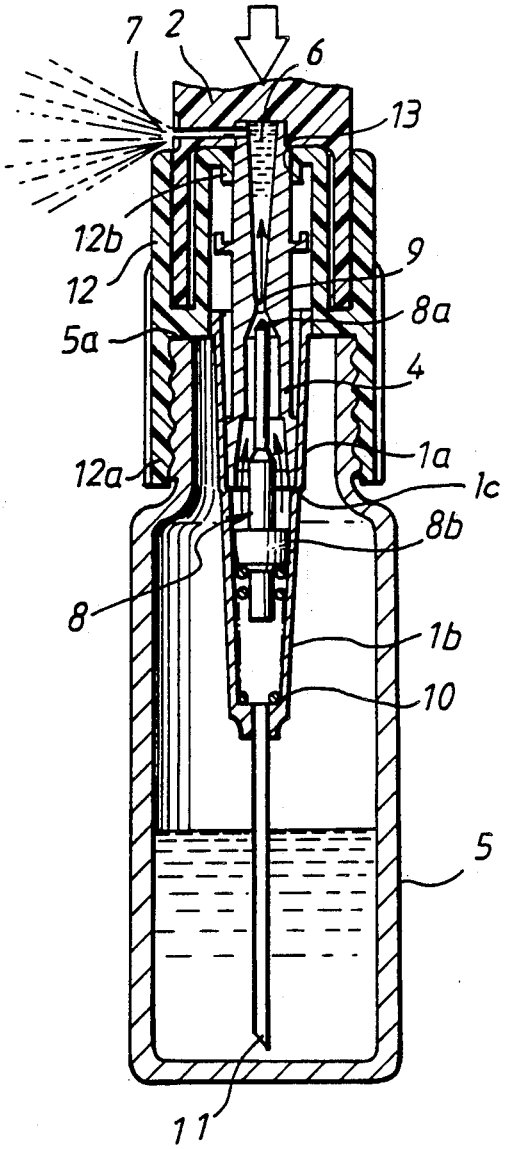
FIG. 2 is a longitudinal cross-section illustrating the embodiment of FIG. 1 with the nozzle head depressed to activate the valve element.
Figure 3:
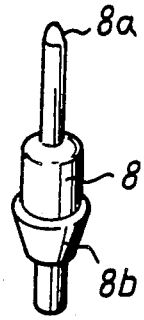
FIG. 3 is an illustration of the valve element covered in the embodiment shown in FIG. 1.

Referring to FIG. 1, showing the atomizer of the present invention in a longitudinal cross section while no depression is made to the nozzle head thereof, it will be seen that the cylinder 1 comprises, in combination, a portion of larger diameter 1*a* and one of a reduced diameter 1*b*, the larger diameter 1*a* telescopingly engaged with a hollow-set piston 4 provided as part of the plunger 3 of the nozzle head. The lower end of the reduced diameter 1*b* extends in the form of a suction tube 11 into the vessel 5. The valve seat 1*c* lies between the larger diameter portion 1*a* and the reduced diameter portion 1*b*. The nozzle 7 is in connection with plunger 3 through opening 6. One end of the valve element 8 points upwards and forms a tight-bound valve body 8*a* together with valve seat 9 and is mounted central to the opening 6. The valve element 8 is fitted in cylinder 1, the valve body 8*a* being borne against the valve seat 9 by means of spring 10 fitted in the reduced diameter portion 1*b*. The lower part of the valve element 8 is structured such that the interior of the reduced diameter 1*b* will maintain a tight-bound engagement with the piston 8*b* upon depression of the nozzle head 2. According to this illustrative embodiment, piston 8*b* is made from emollient resin materials having highly reliable water and ethyl alcohol tightness characteristics. Initial depression in operation will bring liquids A into cylinder 1 through suction, spraying of atomized particles with the invention is through fingertip depression of the nozzle head 2. In the meantime, the plunger 3 will move downward, the valve seat 9 forming a part of the plunger 3 and being positioned on the valve body 8*a* will move the valve element 8 in conjunction therewith. The hollow-set piston 4, also forming a part of the plunger 3, is telescoped within the larger diameter portion 1*a* in the downward displacement. The underside of the valve element 8 is formed into a piston 8*b* which forms an enclosure with respect to the larger diameter portion 1*a* when slid into engagement with the reduced diameter portion 1*b* of the cylinder 1. The liquids theretofore stored in the space confined by the valve seat 9, relative to the plunger 3, through the cylinder 1 are restricted from flowing into the reduced diameter portion 1*b* and as such are compressed by the depression of the nozzle head 2, to the effect that the piston 8*b* will come into engagement with the reduced diameter portion 1*b* and pressure on the confined liquid will be increased. The pressure passes to the valve element 8 by means of the piston 8*b* thereon. The valve element 8 overcoming the biasing force of spring 10 in response to such pressure is further depressed with concurrent disengagement of the top end of the valve 8*a* from its contact position with the valve seat 9 relative to the plunger 3. As a result, liquid acted upon by the high pressure will instantly find its way out of the nozzle through opening 6 via valve seat 9 in atomized particles. When the nozzle head 2 stops spraying following release, the interior of the cylinder will assume a passive condition, the compression spring 10 automatically lifting the valve element 8 upwards, the piston 8*b* for the valve element 8 rising upward in the reduced diameter portion 1*b*, and functioning as a suction pump therein. Returning more specifically to FIG. 2, it is seen that via suction tube 11 the liquid in the vessel 5 is sucked upwards through the reduced diameter portion 1*b* to reach the cylinder 1 and the interior of plunger 3 and remains there for use in the next operation.

Figure 4:
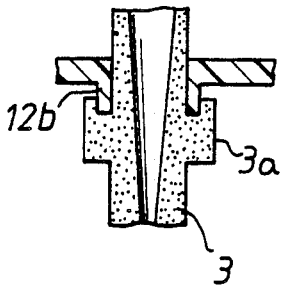
FIG. 4 is a longitudinal cross section of the plunger-lid sealing area on an enlarged scale.

The nozzle head 2 of the atomizer illustrated in FIG. 1 is screwed to lid 12 through threaded area 12*a* formed about the opening 5*a* of the vessel in relation to the cylinder 1. Surrounding the periphery of the plunger 3 is provided flange 12*b* meant to secure in tight-bound condition the liquids contained within. Plunger 3 is connected to the nozzle head 2 overhead by passing through an aperture 13 about which flange 12*b* forms a depending skirt, such an arrangement ensures the absolute leak-free condition of the liquid once established in the vessel container. Such a tight-bound means is provided on the flange 12*b*, as shown in FIG. 4, wherein the flange 12*b*, having a tapered rim thereon, which will secure a tight-bound engagement with the supplementary seal 3*a*, formed as an annular lip on plunger 3 when it is free of pressure, this will help secure a yet more reliable sealing effect and is an optional modification which shall by no means restrict the scope of the invention hereunder.

Figure 5:
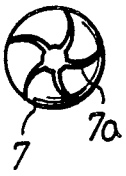
FIG. 5 is a frontal view of the nozzle, prepared according to the invention, on an enlarged scale.
Figure 6:
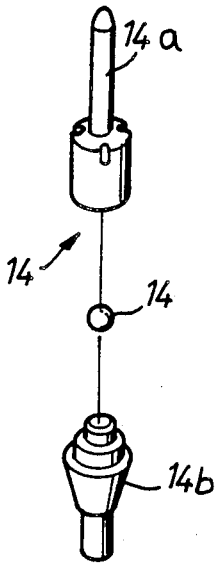
FIG. 6 is a longitudinally exploded schematic of a conventional atomizer using a steel ball type valve element.

The spraying nozzle 7, as illustrated in FIG. 5, and structured hereunder, is provided with a plurality of gently curved grooves 7*a* extending radially to even better enhance the atomization effects. The diversification through moment of torsion will be improved all the more advantageously when the liquids are ejected under high pressure, high speed conditions, since atomized outputs twirling in a curl are seen as tiny mist sprays. Again, the construction of the nozzle herein accounts but for one feature of the invention and by no means shall restrict the scope thereof.

To summarize, the present invention makes possible the provision of a valve element having the characteristics of a regular pump and permitting convenient contact displacements up-and-down between the cylinder and plunger of an atomizer device having excellent atomization performance and defying imitation by like products by the provision of outstanding tight-sealing thereof to maintain advantageous compression efficiency such that the invention device will withstand shock and tilting that would prove detrimental to a regular atomizer structured otherwise. An atomizer structure embodying the invention will not shed liquid drops when driven to yield atomized sprays such as occurs with conventional atomizers utilizing steel ball components within, and has been proven to be economically advantageous for mass production.

What is claimed is:

1. A pump type atomizer comprising:

(a) a movable nozzle head defining a spray nozzle;

(b) a substantially stationary cylinder element, the cylinder element having an upper portion and a lower portion with a maximum diameter less than a diameter of the upper portion, the lower portion having a tapered configuration such that its diameter decreases in a direction away from the upper portion;

(c) means for communicating a source of fluid with the lower portion of the cylinder element;

(d) a plunger attached to the movable nozzle head so as to move axially therewith, the plunger defining a passage extending through the plunger and communicating with the spray nozzle, a valve seat around the passage, and a plunger piston movable within the upper portion of the cylinder element;

(e) a valve element axially located within the cylinder element defining a valve body and a laterally extending piston, said valve element piston being of a lateral dimension greater than a minimum diameter of said lower portion and less than said maximum diameter such that said fluid may pass between said valve element piston and said cylinder in some axial positions of said valve element piston and be prevented from being communicated back to said source of fluid in other axial positions; and (f) biasing means operatively associated with the valve element to normally bias the valve body against the valve seat to close the passage and permit communication of fluid between said source and said cylinder element whereby movement of the movable nozzle head and plunger causes movement of the valve element such that the piston sealingly contacts the lower portion of the cylinder element and prevent flow of fluid from said cylinder element and said source and wherein further movement of the movable nozzle head and plunger pressurizes fluid which acts on the piston to displace the valve body away from the valve seat, thereby allowing the pressurized fluid to pass through the passageway and exit through the spray nozzle.

2. The atomizer of claim 1 further comprising: an assembly comprising said plunger, cylinder element and valve element attached to a liquid reservoir by means of a threaded lid defining an aperture through which said plunger passes; a depending peripheral flange formed on the lid adacent to the aperture; and, an annular lip located on the plunger so as to cooperate with said depending peripheral flange in a tight-bound engagement to prevent leakage of liquid through said aperture.

3. The atomizer of claim 2 wherein said depending peripheral flange has a tapered rim.

4. The atomizer of claim 1 wherein the nozzle is provided with a plurality of curved, radially extending, atomization enhancing grooves.

* * * * *